US011176864B2

(12) United States Patent
Li et al.

(10) Patent No.: US 11,176,864 B2
(45) Date of Patent: Nov. 16, 2021

(54) METHOD FOR DRIVING A DISPLAY PANEL, DISPLAY DRIVE CIRCUIT AND DISPLAY DEVICE

(71) Applicants: Beijing BOE Optoelectronics Technology Co., Ltd., Beijing (CN); BOE Technology Group Co., Ltd., Beijing (CN)

(72) Inventors: Yafei Li, Beijing (CN); Bo Gao, Beijing (CN); Wei Sun, Beijing (CN); Lingyun Shi, Beijing (CN); Hao Zhang, Beijing (CN); Guangquan Wang, Beijing (CN); Ming Chen, Beijing (CN); Xue Dong, Beijing (CN); Yue Li, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 329 days.

(21) Appl. No.: 16/332,947

(22) PCT Filed: Aug. 29, 2018

(86) PCT No.: PCT/CN2018/103090
§ 371 (c)(1),
(2) Date: Mar. 13, 2019

(87) PCT Pub. No.: WO2019/091193
PCT Pub. Date: May 16, 2019

(65) Prior Publication Data

US 2021/0174724 A1 Jun. 10, 2021

(30) Foreign Application Priority Data

Nov. 13, 2017 (CN) ..... 201711115424.2

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01);
(Continued)

(58) Field of Classification Search
CPC ..... G09G 3/2003; G09G 2300/0452; G09G 2310/0267; G09G 2310/027; G09G 2340/0457
See application file for complete search history.

(56) References Cited

U.S. PATENT DOCUMENTS

2009/2007195 8/2009 Chin et al.
2020/0273431 A1* 8/2020 Dong ..... G09G 3/20

FOREIGN PATENT DOCUMENTS

CN 105915907 A * 8/2016
CN 106920501 A * 7/2017 ..... G09G 5/37
(Continued)

OTHER PUBLICATIONS

International Search Report for (PCT/CN2018/103090 dated Nov. 12, 2018.

*Primary Examiner* — Kenneth B Lee, Jr.
(74) *Attorney, Agent, or Firm* — Arent Fox LLP; Michael Fainberg

(57) ABSTRACT

A method for driving a display panel, a display drive circuit, a display device and a computer device are disclosed. After receiving an image to be displayed sent by a graphics processor, a data drive chip controls respective rows of sub-pixels containing a high-definition display area in a connected display panel to be scanned line by line according to a position of the high-definition display area in the image to be displayed, and at the same time, the data drive chip controls respective rows of sub-pixels containing only a
(Continued)

low-definition display area in the display panel to be scanned per N rows simultaneously according to a position of the low-definition display area in the image to be displayed, where N is an even number greater than 1.

18 Claims, 7 Drawing Sheets

(52) U.S. Cl.
CPC ..... *G09G 2310/0267* (2013.01); *G09G 2340/0457* (2013.01)

(56) References Cited

FOREIGN PATENT DOCUMENTS

| | | | |
|---|---|---|---|
| CN | 106920501 | A | 7/2017 |
| CN | 106935224 | A | 7/2017 |
| CN | 107093410 | A | 8/2017 |
| CN | 107195278 | A | 9/2017 |
| CN | 107767808 | A | 3/2018 |

* cited by examiner

METHOD FOR DRIVING A DISPLAY PANEL, DISPLAY DRIVE CIRCUIT AND DISPLAY DEVICE

This application is a National Stage of International Application No. PCT/CN2018/103090, filed Aug. 29, 2018, which claims priority to Chinese Patent Application No. 201711115424.2, filed Nov. 13, 2017, both of which are hereby incorporated by reference in their entireties.

FIELD

This disclosure relates to the field of display technologies, and particularly to a method for driving a display panel, a display drive circuit, a display device and a computer device.

BACKGROUND

With the increasingly high demand for the display resolution and the refresh rate, the requirement for the charging time of a display panel becomes higher too. Especially in the virtual reality technology (VR/AR), since an area viewed by human eyes needs to be analyzed in real time, and then a high-definition imaging area with high visual acuity required by the human eyes needs to be rendered, in order to achieve a good virtual reality display effect, the demand for the display resolution and the refresh rate are very high.

SUMMARY

The embodiments of the disclosure provide a method for driving a display panel, a display drive circuit, a display device and a computer device. The particular schemes are as follows.

The embodiments of the disclosure provide a method for driving a display panel, including: receiving, by a data drive chip, an image to be displayed sent by a graphics processor, where the image to be displayed includes grayscale data of a high-definition display area and a low-definition display area; controlling, by the data drive chip, respective rows of sub-pixels containing the high-definition display area in a connected display panel to be scanned line by line according to a position of the high-definition display area; and controlling, by the data drive chip, respective rows of sub-pixels containing only the low-definition display area in the display panel to be scanned per N rows simultaneously according to a position of the low-definition display area, where N is an even number greater than 1.

Optionally, in the method above according to the embodiments of the disclosure, respective sub-pixels in every two adjacent rows of sub-pixels in the display panel are staggered by X sub-pixels in a column direction, where $0<X<1$, and each sub-pixel has a different display color from that of an adjacent sub-pixel.

Optionally, in the method above according to the embodiments of the disclosure, controlling, by the data drive chip, the respective rows of sub-pixels containing only the low-definition display area in the display panel to be scanned per N rows simultaneously includes: inputting, by the data drive chip, same grayscale data to sub-pixels with a same display color connected with a same data line in every N rows of sub-pixels containing only the low-definition display area; and adjusting and outputting, by the data drive chip, corresponding grayscale data to an edge sub-pixel in an even row of sub-pixels containing only the low-definition display area, according to a grayscale and a weight of an adjacent sub-pixel with a same display color.

Optionally, in the method above according to the embodiments of the disclosure, controlling, by the data drive chip, the respective rows of sub-pixels containing the high-definition display area in the connected display panel to be scanned line by line according to the position of the high-definition display area includes: inputting, by the data drive chip, same grayscale data to sub-pixels with a same display color connected with a same data line in the low-definition display area in every N rows of sub-pixels containing both the high-definition display area and the low-definition display area.

Optionally, in the method above according to the embodiments of the disclosure, the controlling, by the data drive chip, the respective rows of sub-pixels containing the high-definition display area in the connected display panel to be scanned line by line according to the position of the high-definition display area further includes: adjusting and outputting, by the data drive chip, corresponding grayscale data to an edge sub-pixel in an even row of sub-pixels in the low-definition display area in every N rows of sub-pixels containing both the high-definition display area and the low-definition display area, according to a grayscale and a weight of an adjacent sub-pixel with a same display color.

Optionally, in the method above according to the embodiments of the disclosure, controlling, by the data drive chip, the respective rows of sub-pixels containing the high-definition display area in the connected display panel to be scanned line by line according to the position of the high-definition display area includes: adjusting and outputting, by the data drive chip, corresponding grayscale data to sub-pixels in the high-definition display area in the respective rows of sub-pixels containing the high-definition display area in the display panel, according to the grayscale data of the high-definition display area in the image to be displayed.

Optionally, in the method above according to the embodiments of the disclosure, before the data drive chip receives the image to be displayed sent by the graphics processor, the method further includes: compressing, by the graphics processor, grayscale data of a low-definition display area in an original image according to a set compression ratio; merging, by the graphics processor, the compressed grayscale data of the low-definition display area with the grayscale data of the high-definition display area and then sending them to the data drive chip; and stretching, by the data drive chip, the received grayscale data of the low-definition display area according to the number of data lines in the display panel and the compression ratio.

Optionally, in the method above according to the embodiments of the disclosure, the compression ratio specifies N times of longitudinal compression.

Optionally, in the method above according to the embodiments of the disclosure, stretching, by the data drive chip, the received grayscale data of the low-definition display area according to the number of data lines in the display panel and the compression ratio includes: stretching, by the data drive chip, the received grayscale data of the low-definition display area only transversely, according to the number of the data lines in the display panel and a transverse compression ratio in the compression ratio, where a transverse stretching ratio is in direct proportion to the number of the data lines and the transverse compression ratio in the compression ratio.

In another aspect, the embodiments of the disclosure provide a display drive circuit, including a data drive chip and a graphics processor, where: the graphics processor is configured to send an image to be displayed to the data drive chip, where the image to be displayed includes grayscale data of a high-definition display area and a low-definition display area; and the data drive chip is connected with the graphics processor, and is configured to control respective rows of sub-pixels containing the high-definition display area in a connected display panel to be scanned line by line according to a position of the high-definition display area, and control respective rows of sub-pixels containing only the low-definition display area in the display panel to be scanned per N rows simultaneously according to a position of the low-definition display area, where N is an even number greater than 1.

Optionally, in the display drive circuit above according to the embodiments of the disclosure, respective sub-pixels in every two adjacent rows of sub-pixels in the display panel are staggered by X sub-pixels in a column direction, where $0<X<1$, and each sub-pixel has a different display color from that of an adjacent sub-pixel.

Optionally, in the display drive circuit above according to the embodiments of the disclosure, the data drive chip includes: a first processing element, configured to input same grayscale data to sub-pixels with a same display color connected with a same data line in every N rows of sub-pixels containing only the low-definition display area; and a first edge processing element, configured to adjust and output corresponding grayscale data to an edge sub-pixel in an even row of sub-pixels containing only the low-definition display area, according to a grayscale and a weight of an adjacent sub-pixel with a same display color.

Optionally, in the display drive circuit above according to the embodiments of the disclosure, the data drive chip further includes: a second processing element, configured to input same grayscale data to sub-pixels with a same display color connected with a same data line in the low-definition display area in every N rows of sub-pixels containing both the high-definition display area and the low-definition display area.

Optionally, in the display drive circuit above according to the embodiments of the disclosure, the data drive chip further includes: a second edge processing element, configured to adjust and output corresponding grayscale data to an edge sub-pixel in an even row of sub-pixels in the low-definition display area in every N rows of sub-pixels containing both the high-definition display area and the low-definition display area, according to a grayscale and a weight of an adjacent sub-pixel with a same display color.

Optionally, in the display drive circuit above according to the embodiments of the disclosure, the data drive chip is further configured to adjust and output corresponding grayscale data to sub-pixels in the high-definition display area in the respective rows of sub-pixels containing the high-definition display area in the display panel, according to the grayscale data of the high-definition display area in the image to be displayed.

Optionally, in the display drive circuit above according to the embodiments of the disclosure, the graphics processor includes a compression element and a merging element, where the compression element is configured to compress grayscale data of a low-definition display area in an original image according to a set compression ratio; the merging element is configured to merge the compressed grayscale data of the low-definition display area with the grayscale data of the high-definition display area and then send them to the data drive chip; and the data drive chip further includes a stretching element, configured to stretch the received grayscale data of the low-definition display area according to the number of data lines in the display panel and the compression ratio.

Optionally, in the display drive circuit above according to the embodiments of the disclosure, the compression ratio of the compression element specifies N times of longitudinal compression.

Optionally, in the display drive circuit above according to the embodiments of the disclosure, the stretching element is configured to only stretch the received grayscale data of the low-definition display area transversely according to the number of the data lines in the display panel and a transverse compression ratio in the compression ratio, where a transverse stretching ratio is in direct proportion to the number of the data lines and the transverse compression ratio in the compression ratio.

In still another aspect, the embodiments of the disclosure provide a display device, including the display drive circuit above according to the embodiments of the disclosure and a display panel.

In yet another aspect, the embodiments of the disclosure provide a computer device, including a memory and a processor, where the memory stores computer programs and the computer programs are configured to be executed by the processor to perform the method above according to the embodiments of the disclosure.

DETAILED DESCRIPTION OF THE EMBODIMENTS

In order to make the objects, technical solutions, and advantages of the embodiments of the disclosure more apparent, the particular embodiments of a method for driving a display panel, a display drive circuit and a display device according to the embodiments of the disclosure will be described below clearly and fully with reference to the drawings in the embodiments of the disclosure, and apparently the embodiments described below are only a part but not all of the embodiments of the disclosure. Based upon the embodiments here of the disclosure, all the other embodiments which can occur to those skilled in the art without any inventive effort shall fall into the scope of the disclosure.

Figure 1:
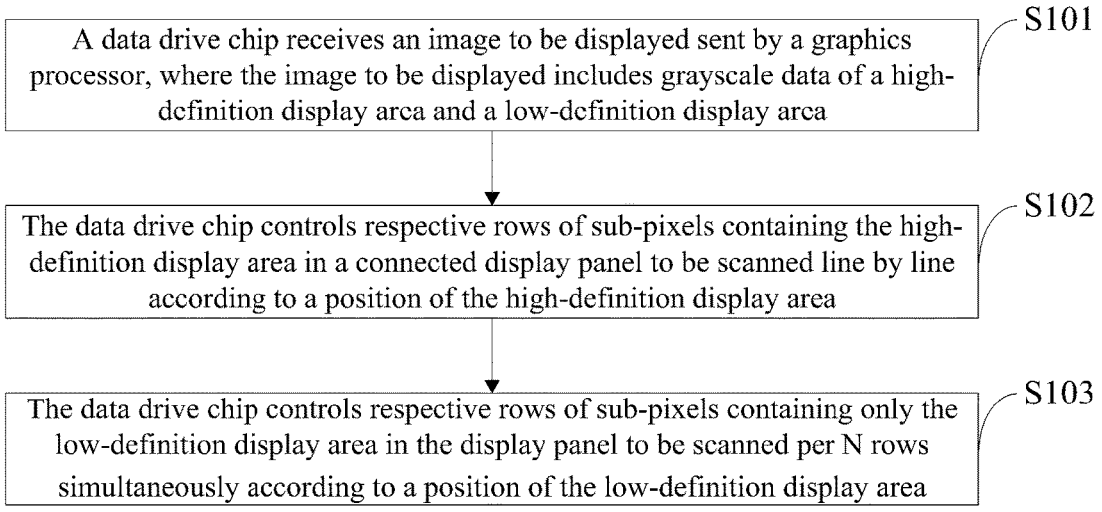
FIG. 1 is a flowchart of a method for driving a display panel according to the embodiments of the disclosure.

A method for driving a display panel according to the embodiments of the disclosure, as illustrated in FIG. 1, includes following operations.

S101, a data drive chip receives an image to be displayed sent by a graphics processor, where the image to be displayed includes grayscale data of a high-definition display area and a low-definition display area.

S102, the data drive chip controls respective rows of sub-pixels containing the high-definition display area in a connected display panel to be scanned line by line according to a position of the high-definition display area.

S103, the data drive chip controls respective rows of sub-pixels containing only the low-definition display area in the display panel to be scanned per N rows simultaneously according to a position of the low-definition display area, where N is an even number greater than 1.

Particularly, in the method above for driving the display panel according to the embodiments of the disclosure, after the data drive chip receives the image to be displayed sent by the graphics processor, since the data drive chip controls the respective rows of sub-pixels containing the high-definition display area in the connected display panel to be scanned line by line according to the position of the high-definition display area in the image to be displayed, a clear display of an image of the high-definition display area can be realized. In addition, since the data drive chip controls the respective rows of sub-pixels containing only the low-definition display area in the display panel to be scanned per N rows simultaneously according to the position of the low-definition display area in the image to be displayed, where N is an even number greater than 1, compared with the line-by-line scanning, the refresh rate of the low-definition display area can be increased, thereby effectively reducing the number of refresh rows displayed per frame and a total number of scanning rows displayed per frame, and thus saving the scanning time per frame; further, under the condition of the same scanning time per frame, the charging time of the display panel can be increased to satisfy the high-speed and low-power consumption display requirement.

Particularly, in the method above for driving the display panel according to the embodiments of the disclosure, the operations S102 and S103 are generally performed at the same time, regardless of sequential order. And in the operation S103, there may be various options for simultaneous scanning per N rows, such as simultaneous scanning per two rows, simultaneous scanning per four rows or simultaneous scanning per eight rows, which are not limited herein. Where a following description will be made based on the example that the data drive chip controls the respective rows of sub-pixels containing only the low-definition display area to be scanned per four rows simultaneously.

Figure 2:
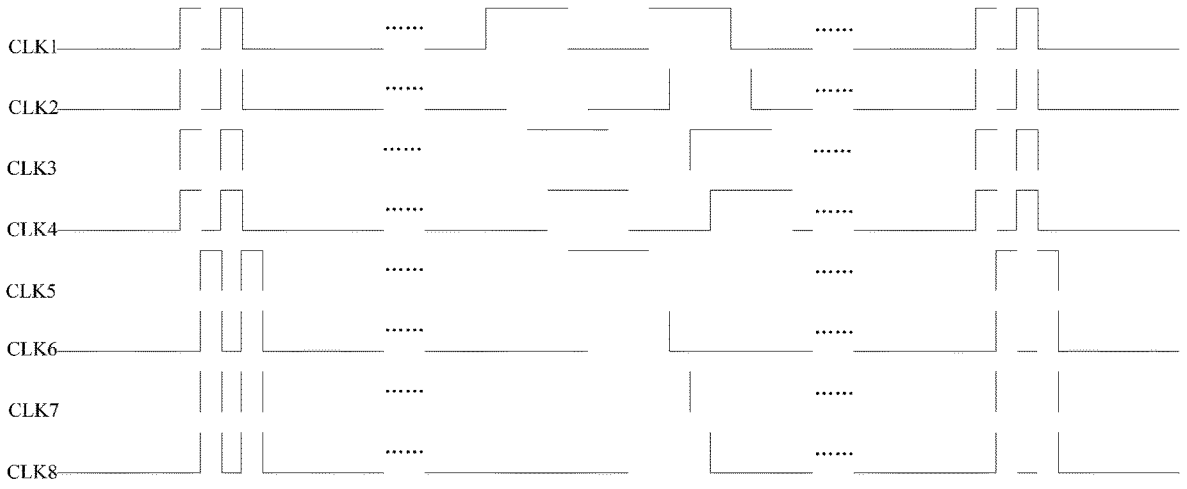
FIG. 2 is a time sequence diagram of clock signals in a driving method according to the embodiments of the disclosure.
Figure 5:
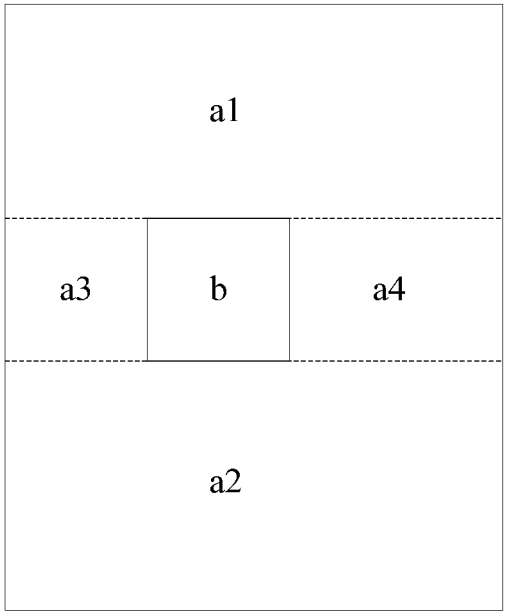
FIG. 5 is a schematic distribution diagram of a high-definition display area and a low-definition display area of a display panel in a driving method according to the embodiments of the disclosure.

Particularly, in the method above for driving the display panel according to the embodiments of the disclosure, the change of the number of scanning rows in the connected display panel, controlled by the data drive chip, in the operations S102 and S103 is mainly achieved by controlling the change of clock signals applied to the display panel. Particularly, as illustrated in FIG. 2 and FIG. 5, when scanning the respective rows of sub-pixels containing only the low-definition display areas a1 and a2, the data drive chip can simultaneously load the same first clock signal to clock signal terminals CLK1-4 of the display panel and load a second clock signal opposite to the first clock signal to clock signal terminals CLK5-8 of the display panel, so as to realize simultaneous scanning of the respective rows of sub-pixels containing only the low-definition display areas a1 and a2 per four rows. When scanning the respective rows of sub-pixels containing the high-definition display area b, as illustrated by the dotted box in FIG. 2, the data drive chip can load the first clock signal to the clock signal terminals CLK1-4 of the display panel sequentially, and load the second clock signal, opposite to the first clock signal of the clock signal terminals CLK1-4, to the clock signal terminals CLK5-8 of the display panel respectively, so as to scan the respective rows of sub-pixels containing the high-definition display area line by line.

Figure 3:
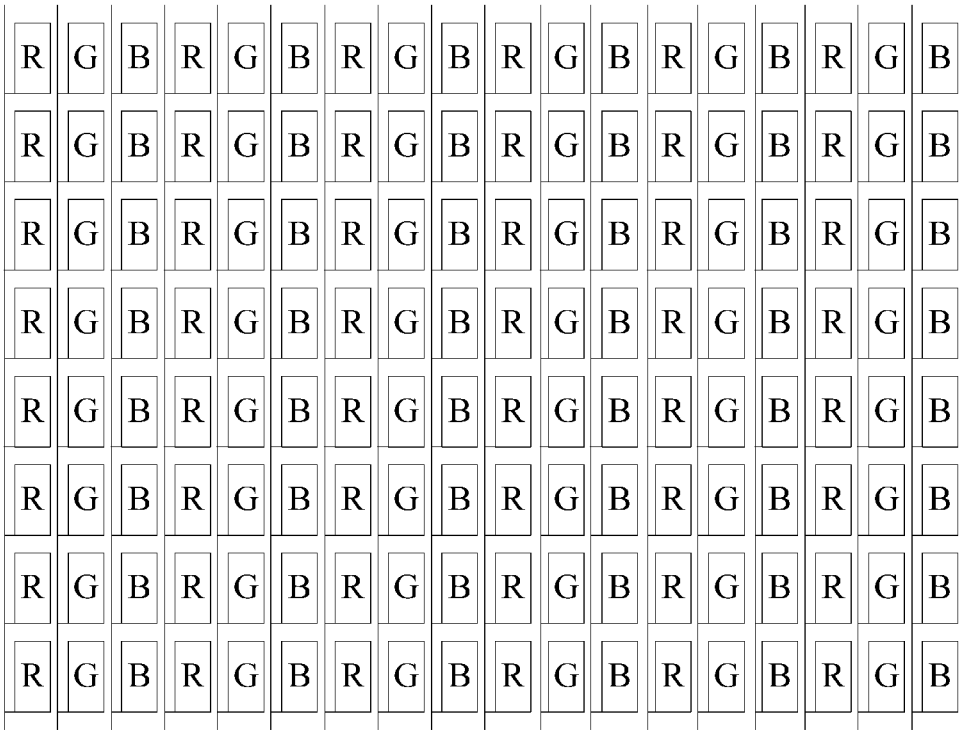
FIG. 3 is a schematic diagram of pixel arrangement of a display panel to which a driving method according to the embodiments of the disclosure is applied.
Figure 4:
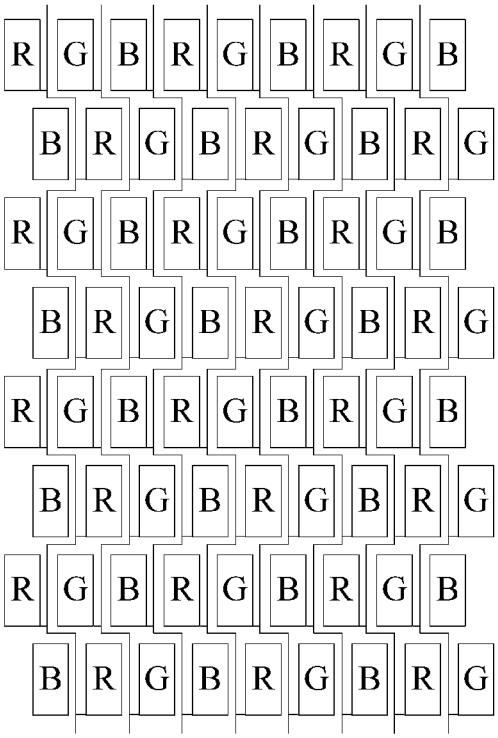
FIG. 4 is another schematic diagram of pixel arrangement of a display panel to which a driving method according to the embodiments of the disclosure is applied.

Optionally, in the method above for driving the display panel according to the embodiments of the disclosure, the sub-pixels in the display panel can be arranged in various ways, for example, as illustrated in FIG. 3, the sub-pixels can be aligned in both a row direction and a column direction, and the display color of the sub-pixels in each column is the same. As illustrated in FIG. 4, respective sub-pixels in every two adjacent rows of sub-pixels in the display panel are staggered by X sub-pixels in the column direction, where $0<X<1$, and each sub-pixel has a different display color from that of an adjacent sub-pixel; in this case, each data line extends along a folded line as illustrated in FIG. 4 instead of along a straight line as illustrated in FIG. 3, and in order to ensure that one data line is connected with only the sub-pixels of the same display color, each data line is connected with sub-pixels on both sides thereof through switch transistors respectively.

In a particular implementation, the pixel arrangement illustrated in FIG. 4 can achieve a display resolution twice the physical resolution by using a specific driving method during display. Therefore, the pixel arrangement illustrated in FIG. 4 can save half the number of sub-pixels and half the number of data lines under the same display resolution as the conventional pixel arrangement illustrated in FIG. 3, thereby effectively reducing the process difficulty of the display panel.

Optionally, in the method above for driving the display panel according to the embodiments of the disclosure, while the data drive chip controls the respective rows of sub-pixels containing only the low-definition display area in the display panel to be scanned per N rows simultaneously in the operation S103, the following operation can be further executed: the data drive chip inputs the same grayscale data to sub-pixels with the same display color connected with the same data line in every N rows of sub-pixels containing only the low-definition display area; that is, when N rows of sub-pixels are scanned simultaneously, one data line will communicate with N sub-pixels with the same display color in the N rows of sub-pixels at the same time, to load the same grayscale data to the N sub-pixels, for example, one data line connected with red sub-pixels will load the same grayscale data to four red sub-pixels when four rows of sub-pixels are scanned simultaneously.

Particularly, on the basis that the data drive chip controls the respective rows of sub-pixels containing only the low-definition display area in the display panel to be scanned per N rows simultaneously, which allows the refresh rate of the low-definition display area to be increased, thereby effectively reducing the number of refresh rows displayed per frame and a total number of scanning rows displayed per frame, and thus saving the scanning time per frame, and increasing the charging time of the display panel, the data drive chip inputs the same grayscale data for the sub-pixels with the same display color connected with the same data line in every N rows of sub-pixels containing only the low-definition display area, which can reduce the amount of grayscale data loaded by the data drive chip on the data lines, thereby reducing the amount of data processing in the data drive chip to save the power consumption of the data drive chip.

Based upon the pixel arrangement structure illustrated in FIG. 4, in the method above for driving the display panel according to the embodiments of the disclosure, while the data drive chip inputs the same grayscale data to the sub-pixels with the same display color connected with the same data line in every N rows of sub-pixels containing only the low-definition display area, the following operation can be executed: the data drive chip adjusts and outputs corresponding grayscale data to an edge sub-pixel in an even row of sub-pixels containing only the low-definition display area, according to a grayscale and a weight of an adjacent sub-pixel with the same display color; that is, the edge grayscale data of each left edge sub-pixel B of each even row need to be adjusted separately, for example, and the grayscale data of the pixel can be assigned according to weights and grayscale data of three adjacent sub-pixels B to the right, above and below, so as to meet the display requirement.

Optionally, in the method above for driving the display panel according to the embodiments of the disclosure, as illustrated in FIG. 5, since the high-definition display area b is generally located only in the middle part of the display panel and does not cover an entire row of sub-pixels, the operation S102 that the data drive chip controls the respective rows of sub-pixels containing the high-definition display area in the connected display panel to be scanned line by line according to the position of the high-definition display area generally includes: the data drive chip controls respective rows of sub-pixels containing both the high-definition display area and the low-definition display area to be scanned line by line according to the position of the high-definition display area; that is, the data drive chip controls respective rows of sub-pixels containing both the high-definition display area b and the low-definition display areas a3 and a4 illustrated in FIG. 5 to be scanned line by line.

Optionally, in the method above for driving the display panel according to the embodiments of the disclosure, while the data drive chip controls the respective rows of sub-pixels containing both the high-definition display area and the low-definition display area to be scanned line by line according to the position of the high-definition display area, the following operation can further be executed: the data drive chip inputs the same grayscale data to sub-pixels with the same display color connected with the same data line in the low-definition display area in every N rows of sub-pixels containing both the high-definition display area and the low-definition display area. As illustrated in FIG. 5, although the low-definition display areas a3 and a4 on both sides of the high-definition display area b are also scanned line by line, the data drive chip reads out four lines of pixel contents from one line of pixel contents in a line buffer of the low-definition display areas a3 and a4 to provide to four rows of sub-pixels in the low-definition display areas a3 and a4 for display respectively, which can reduce the amount of grayscale data loaded by the data drive chip on the data lines, thereby reducing the amount of data processing in the data drive chip so as to save the power consumption of the data drive chip. Particularly, for sub-pixels of odd rows in the low-definition display areas a3 and a4, the data drive chip can directly send grayscale data to those sub-pixels for display, and for even rows in the pixel arrangement illustrated in FIG. 4, pixel adjustment needs to be performed correspondingly, for example, the grayscale data of RGB and BRG in the pixels are exchanged and then sent for display.

Optionally, in the method above for driving the display panel according to the embodiments of the disclosure, the operation that the data drive chip controls the respective rows of sub-pixels containing the high-definition display area in the connected display panel to be scanned line by line according to the position of the high-definition display area further includes: the data drive chip adjusts and outputs corresponding grayscale data to an edge sub-pixel in an even row of sub-pixels in the low-definition display area in every N rows of sub-pixels containing both the high-definition display area and the low-definition display area, according to a grayscale and a weight of an adjacent sub-pixel with the same display color.

Optionally, in the method above for driving the display panel according to the embodiments of the disclosure, the operation that the data drive chip controls the respective rows of sub-pixels containing the high-definition display area in the connected display panel to be scanned line by line according to the position of the high-definition display area includes: the data drive chip adjusts and outputs corresponding grayscale data sub-pixels in the high-definition display area in the respective rows of sub-pixels containing the high-definition display area in the display panel, according to the grayscale data of the high-definition display area in the image to be displayed.

Figure 8:
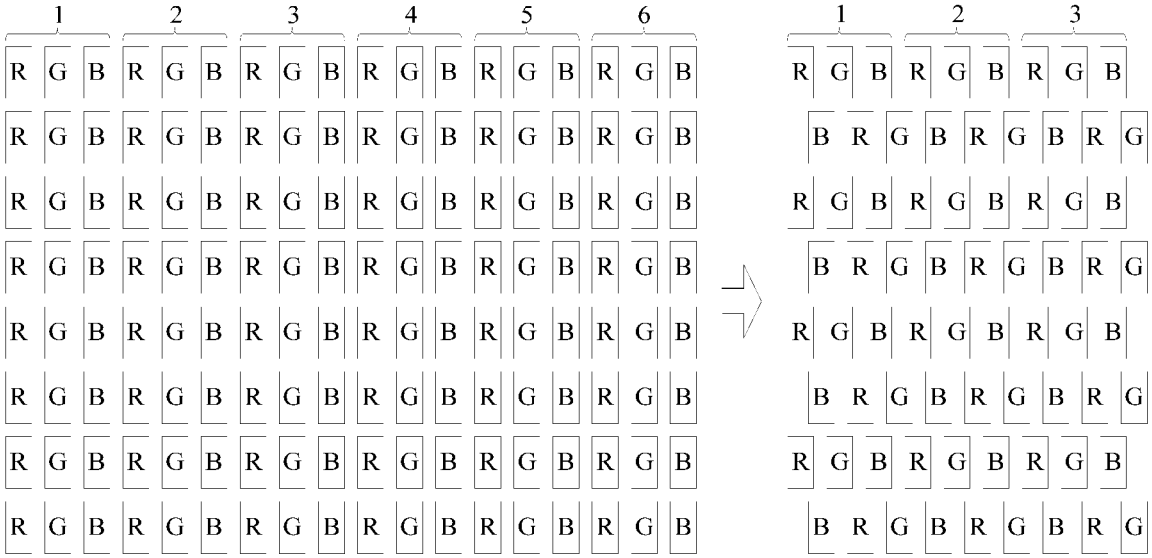
FIG. 8 is a first schematic diagram of processing grayscale data in a high-definition display area in a driving method according to the embodiments of the disclosure.

In a particular implementation, for each sub-pixel in the high-definition display area, the corresponding grayscale data are adjusted and output according to the grayscale data of the high-definition display area in the image to be displayed as follows: taking FIG. 8 as an example, three columns of pixel units in the high-definition display area correspond to six columns of pixel units in an original image, the grayscale data corresponding respectively to the three columns of pixel units in the high-definition display area can be calculated and converted through an algorithm according to the grayscale data of the six columns of pixel units in the original image, and then, based upon the converted grayscale data, grayscale data are assigned on the actual pixel arrangement of the display panel, so that the effect of displaying six columns of pixel units is realized through the three columns of pixel units, that is, a display resolution twice the physical resolution is realized.

Particularly, the grayscale data corresponding respectively to the respective pixel units in the high-definition display area can be calculated according to the grayscale data in the original image by the following algorithm.

Stp1, dividing the original image into theoretical pixel units, where each theoretical pixel unit includes a plurality of theoretical sub-pixels with different colors; and calculating a theoretical brightness value of each theoretical sub-pixel.

Stp2, calculating an actual brightness value of each actual sub-pixel via following operations Stp21 to Stp23.

Stp21, founding out a first theoretical sub-pixel, where a position of the first theoretical sub-pixel in the original image corresponds to a position of the actual sub-pixel to be calculated in a pixel array of the display panel.

Stp22, inserting a plurality of virtual sub-pixels with the same color as the first theoretical sub-pixel between the first theoretical sub-pixel and at least one adjacent theoretical sub-pixel, where each adjacent theoretical sub-pixel is a theoretical sub-pixel adjacent to the first theoretical sub-pixel in all theoretical sub-pixels with the same color as the first theoretical sub-pixel in a row where the first theoretical sub-pixel is located.

Stp23, taking a value, obtained by adding a part of the theoretical brightness value of the first theoretical sub-pixel and a part of a virtual brightness value of a virtual sub-pixel of which a position corresponds to the actual sub-pixel to be calculated, as the actual brightness value of the actual sub-pixel to be calculated, where the virtual brightness value of the virtual sub-pixel is a sum of a part of the theoretical brightness value of the first theoretical sub-pixel and a part of a theoretical brightness value of a corresponding adjacent theoretical sub-pixel.

Figure 6:
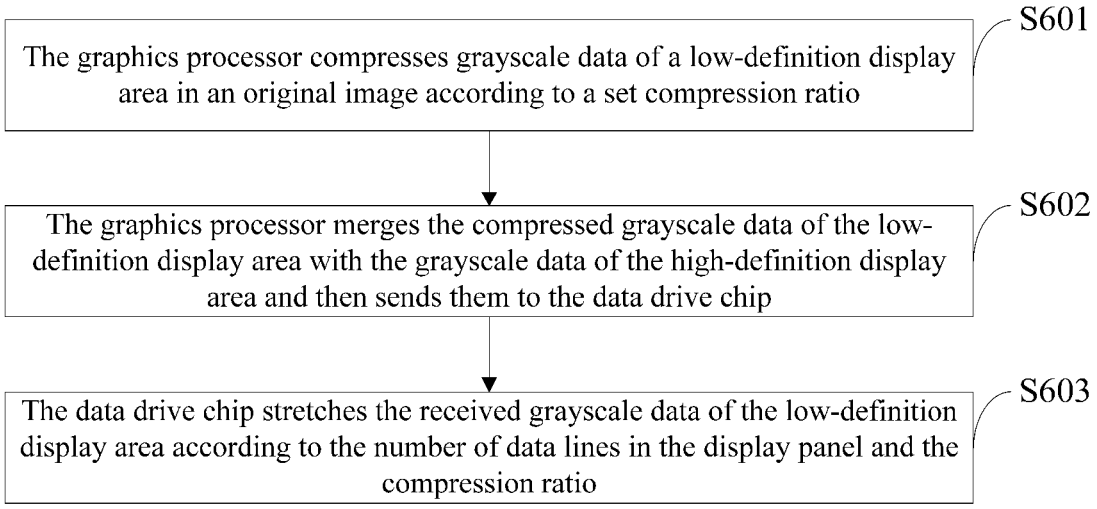
FIG. 6 is another flowchart of a method for driving a display panel according to the embodiments of the disclosure.

Stp3, inputting a signal to each actual sub-pixel so that each actual sub-pixel reaches the actual brightness value calculated in stp2. Optionally, in the method above for driving the display panel according to the embodiments of the disclosure, as illustrated in FIG. 6, before the data drive chip receives the image to be displayed sent by the graphics processor, the method may further include following operations.

S601, the graphics processor compresses grayscale data of a low-definition display area in an original image according to a set compression ratio.

S602, the graphics processor merges the compressed grayscale data of the low-definition display area with the grayscale data of the high-definition display area and then sends them to the data drive chip.

S603, the data drive chip stretches the received grayscale data of the low-definition display area according to the number of data lines in the display panel and the compression ratio.

Particularly, the operations S601 and S602 executed in the graphics processor can ensure that while the high-definition display area displays data, the amount of data transmitted from the graphics processor to the data drive chip can be kept small to improve the data transmission speed, thereby supporting a higher image output frame frequency, reducing the output delay of the GPU (i.e. the graphics processor) and improving the user experience.

Figure 7:
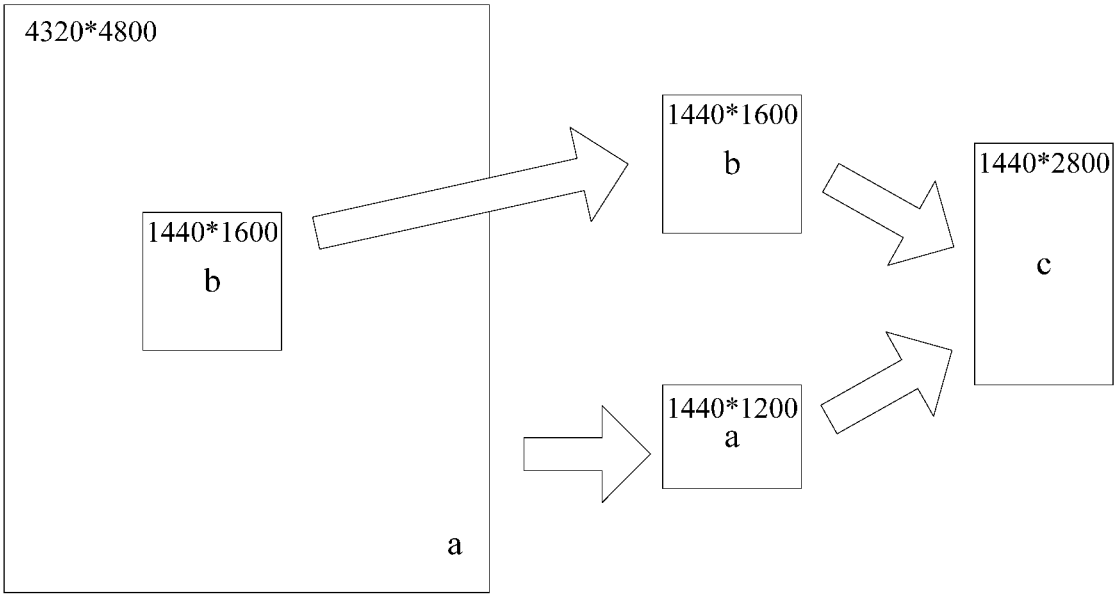
FIG. 7 is a workflow diagram of a graphics processor in a driving method according to the embodiments of the disclosure.

Optionally, in the method above for driving the display panel according to the embodiments of the disclosure, the compression ratio in the above operation S601 may specify N times of longitudinal compression and M times of transverse compression; for example, as illustrated in FIG. 7, the resolution of the original image received by the graphics processor is 4320*4800, where the resolution of the high-definition display area b is 1440*1600, and the resolution of the low-definition display area a is compressed according to the compression ratio of four times in the longitudinal direction and three times in the transverse direction such that the resolution of the compressed low-definition display area a is 1440*1200. After the above operation S602 is executed, the resolution obtained after the grayscale data of the low-definition display area a, and the grayscale data of the high-definition display area b are merged is 1440*2800.

Correspondingly, the above operation S603 that the data drive chip stretches the received grayscale data of the low-definition display area according to the number of data lines in the display panel and the compression ratio includes: the data drive chip only stretches the received grayscale data of the low-definition display area transversely according to the number of the data lines in the display panel and a transverse compression ratio in the compression ratio, where a transverse stretching ratio is in direct proportion to the number of the data lines and the transverse compression ratio in the compression ratio, where a result of dividing the transverse stretching ratio by the transverse compression ratio is equal to a result of dividing the number of pixel columns of the original image by the number of data lines.

Taking the pixel arrangement illustrated in FIG. 3 as an example, the number of data lines is the same as the number of columns in the original image, and the data drive chip needs to perform M times of transverse stretching, for example, 3 times of transverse stretching, that is, grayscale data of three sub-pixels are generated according to one sub-pixel in a row.

Figure 9:
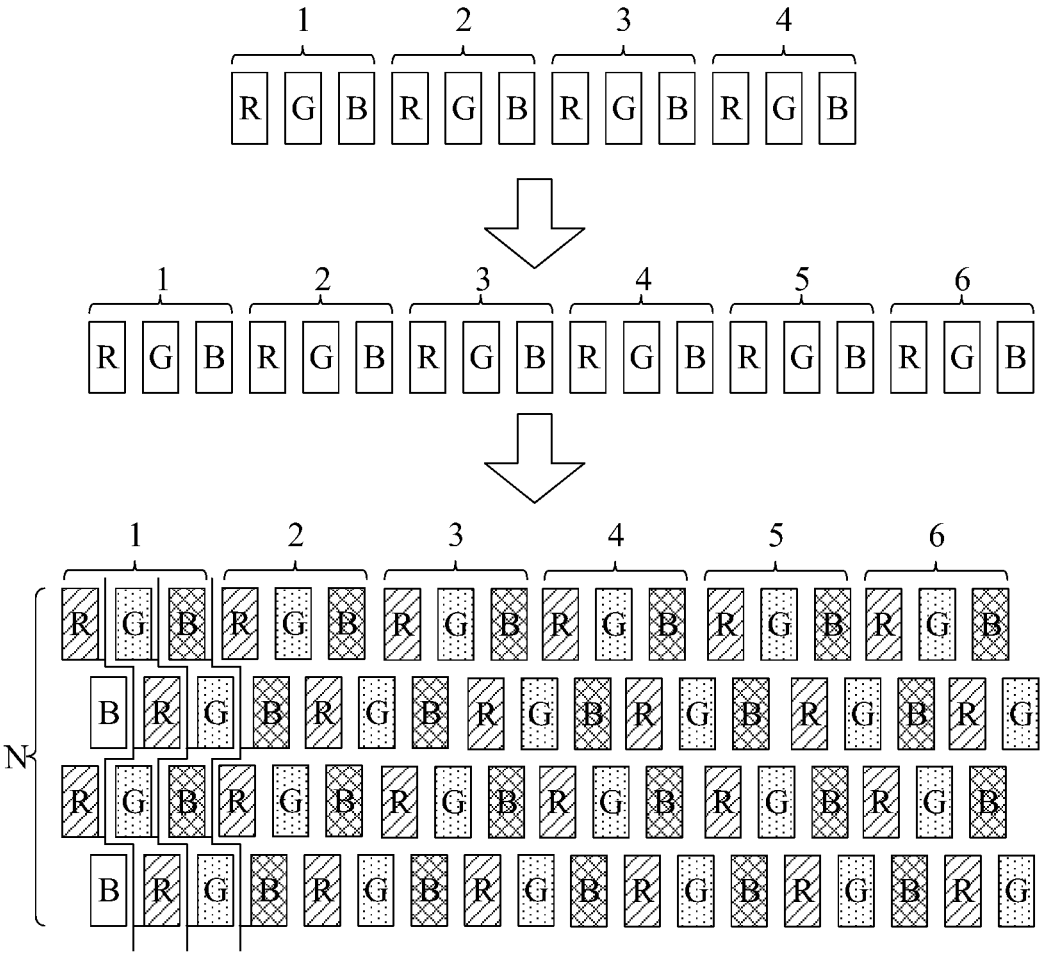
FIG. 9 is a schematic diagram of processing grayscale data in a low-definition display area in a driving method according to the embodiments of the disclosure.
Figure 11:
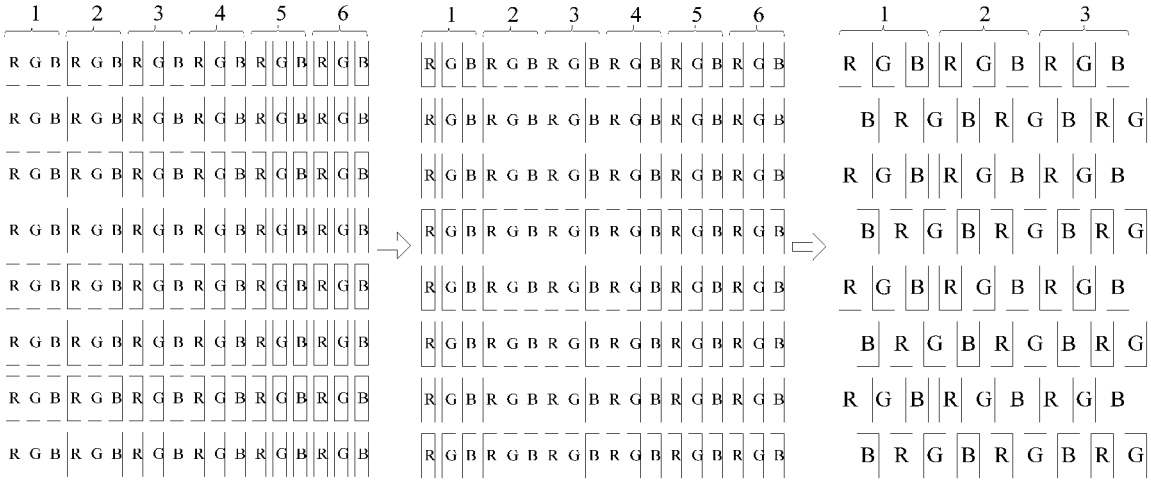
FIG. 11 is a second schematic diagram of processing grayscale data in a high-definition display area in a driving method according to the embodiments of the disclosure.

Taking the pixel arrangement illustrated in FIG. 4 as an example, the number of data lines is reduced by half compared with the number of columns in the original image, the data drive chip needs to perform M/2 times of transverse stretching, for example, 1.5 times of transverse stretching, that is, grayscale data of three sub-pixels are generated according to two sub-pixels in a row. FIG. 9 illustrates a process in which grayscale data of four pixel units in the low-definition display area are transversely stretched by 1.5 times into grayscale data of six pixel units, and then the stretched grayscale data are assigned to six pixel units according to the actual pixel arrangement of the display panel, so that N=4 rows of sub-pixels use the same row of grayscale data to drive for display. FIG. 8 illustrates grayscale data of six columns of pixel units in the high-definition display area in the original image, and the situation that grayscale data assignment is performed on three columns of pixel units in the display panel according to the actual pixel arrangement of the display panel. FIG. 11 illustrates, from left to right, grayscale data of six columns of pixel units in the high-definition display area in the original image, grayscale data of six columns of pixel units in the high-definition display area processed by the graphics processor (the grayscale data of the six columns of pixel units processed by the graphics processor are consistent with the grayscale data of the corresponding six columns of pixel units in the original image), and the situation that grayscale data assignment is performed on three columns of corresponding pixel units in the high-definition display area of the display panel according to the grayscale data of the six columns of pixel units in the high-definition display area processed by the graphics processor.

Based upon the same inventive concept, the embodiments of the disclosure further provide a display drive circuit. Since the display drive circuit addresses the problem under a similar principle to the method above for driving the display panel, reference can be made to the implementation of the method above for driving the display panel for an implementation of the display drive circuit, so a repeated description thereof will be omitted here.

Figure 10:
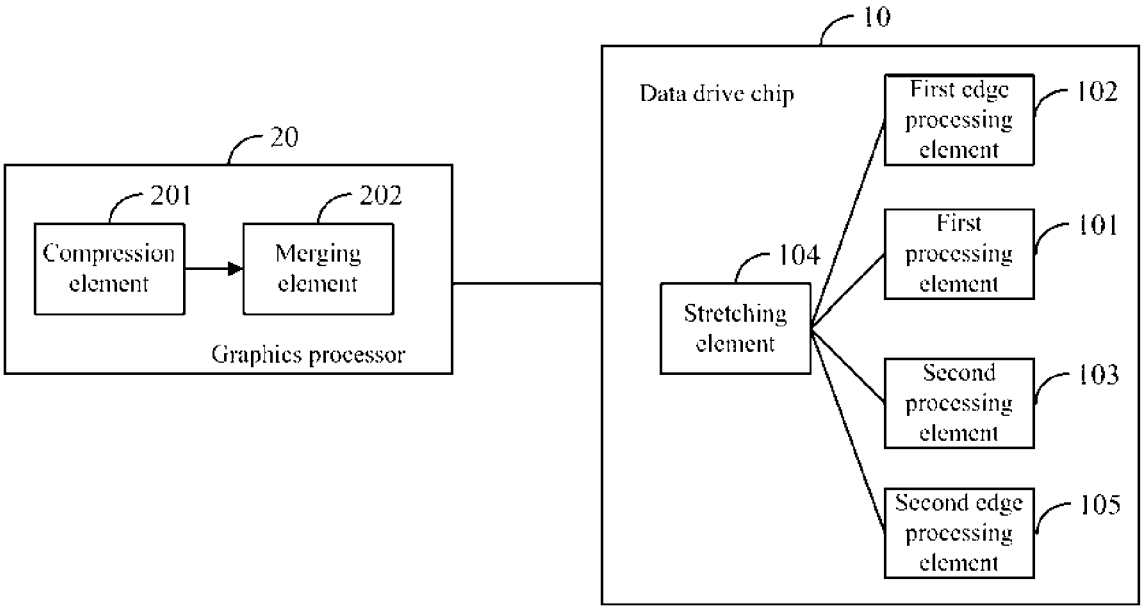
FIG. 10 is a schematic structural diagram of a display drive circuit according to the embodiments of the disclosure.

Particularly, the display drive circuit according to the embodiments of the disclosure, as illustrated in FIG. 10, includes a data drive chip 10 and a graphics processor 20, where the graphics processor 20 is configured to send an image to be displayed to the data drive chip 10, where the image to be displayed includes grayscale data of a high-definition display area a and a low-definition display area b; and the data drive chip 10 is connected with the graphics processor 20, and is configured to control respective rows of sub-pixels containing the high-definition display area a in a connected display panel to be scanned line by line according to a position of the high-definition display area a, and control respective rows of sub-pixels containing only the low-definition display area b in the display panel to be scanned per N rows simultaneously according to a position of the low-definition display area b; where N is an even number greater than 1.

Optionally, in the display drive circuit above according to the embodiments of the disclosure, respective sub-pixels in every two adjacent rows of sub-pixels in the display panel are staggered by X sub-pixels in a column direction, where $0<X<1$, and each sub-pixel has a different display color from that of an adjacent sub-pixel.

Optionally, in the display drive circuit above according to the embodiments of the disclosure, as illustrated in FIG. 10, the data drive chip 10 includes: a first processing element 101, configured to input the same grayscale data for sub-pixels with the same display color connected with the same data line in every N rows of sub-pixels containing only the low-definition display area b.

Optionally, in the display drive circuit above according to the embodiments of the disclosure, as illustrated in FIG. 10, the data drive chip 10 may further include: a first edge processing element 102, configured to adjust and output corresponding grayscale data to an edge sub-pixel in an even row of sub-pixels containing only the low-definition display area b, according to a grayscale and a weight of an adjacent sub-pixel with the same display color.

Optionally, in the display drive circuit above according to the embodiments of the disclosure, the data drive chip 10 is particularly configured to control the respective rows of sub-pixels containing both the high-definition display area a and the low-definition display area b to be scanned line by line according to the position of the high-definition display area a.

Optionally, in the display drive circuit above according to the embodiments of the disclosure, as illustrated in FIG. 10, the data drive chip 10 may further include: a second processing element 103, configured to input the same grayscale data for sub-pixels with the same display color connected with the same data line in the low-definition display area b in every N rows of sub-pixels containing both the high-definition display area a and the low-definition display area b.

Optionally, in the display drive circuit above according to the embodiments of the disclosure, as illustrated in FIG. 10, the data drive chip 10 may further include: a second edge processing element 105, configured to adjust and output corresponding grayscale data to an edge sub-pixel in an even row of sub-pixels in the low-definition display area in every N rows of sub-pixels containing both the high-definition display area and the low-definition display area, according to a grayscale and a weight of an adjacent sub-pixel with a same display color.

Optionally, in the display drive circuit above according to the embodiments of the disclosure, the data drive chip 10 is particularly configured to adjust and output corresponding grayscale data to sub-pixels in the high-definition display area in the respective rows of sub-pixels containing the high-definition display area in the display panel, according to the grayscale data of the high-definition display area in the image to be displayed.

Optionally, in the display drive circuit above according to the embodiments of the disclosure, as illustrated in FIG. 10, the graphics processor 20 includes a compression element 201 and a merging element 202, where the compression element 201 is configured to compress grayscale data of a low-definition display area in an original image according to a set compression ratio; the merging element 202 is configured to merge the compressed grayscale data of the low-definition display area with the grayscale data of the high-definition display area and then send them to the data drive chip; and the data drive chip 10 may further include a stretching element 104, configured to stretch the received grayscale data of the low-definition display area according to the number of data lines in the display panel and the compression ratio.

Optionally, in the display drive circuit above according to the embodiments of the disclosure, the compression ratio of the compression element 201 specifies N times of longitudinal compression.

Optionally, in the display drive circuit above according to the embodiments of the disclosure, the stretching element 104 is configured to only stretch the received grayscale data of the low-definition display area transversely according to the number of the data lines in the display panel and a transverse compression ratio in the compression ratio, where a transverse stretching ratio is in direct proportion to the number of the data lines and the transverse compression ratio in the compression ratio.

Based upon the same inventive concept, the embodiments of the disclosure further provide a display device, including the display drive circuit above according to the embodiments of the disclosure, and a display panel. The display device can be any product or component with a display function such as a mobile phone, a tablet computer, VR equipment, a television, a display, a notebook computer, a digital photo frame, and a navigator. Where reference can be made to the implementation of the display drive circuit above for an implementation of the display device, so a repeated description thereof will be omitted here.

Based upon the same inventive concept, the embodiments of the disclosure further provide a computer device, including a memory and a processor, where the memory stores computer programs and the computer programs are configured to be executed by the processor to perform the method above for driving the display panel according to the embodiments of the disclosure. The computer device can be a mobile phone, a tablet computer, a television, VR equipment, etc. Where reference can be made to the implementation of the method above for an implementation of the computer device, so a repeated description thereof will be omitted here.

According to the method for driving the display panel, the display drive circuit, the display device and the computer device above according to the embodiments of the disclosure, after receiving the image to be displayed sent by the graphics processor, the data drive chip controls respective rows of sub-pixels containing the high-definition display area in the connected display panel to be scanned line by line according to the position of the high-definition display area in the image to be displayed, so as to realize a clear display of the image of the high-definition display area; and at the same time, the data drive chip controls respective rows of sub-pixels containing only the low-definition display area in the display panel to be scanned per N rows simultaneously according to the position of the low-definition display area in the image to be displayed, where N is an even number greater than 1, so as to effectively reduce the number of refresh rows displayed per frame, and under the condition of the same scanning time per frame, the charging time of the display panel can be increased to satisfy the high-speed and low-power consumption display requirement.

Those skilled in the art shall appreciate that the embodiments of the disclosure can be embodied as a method, a system or a computer program product. Therefore the disclosure can be embodied in the form of an all-hardware embodiment, an all-software embodiment or an embodiment of software and hardware in combination. Furthermore, the disclosure can be embodied in the form of a computer program product embodied in one or more computer useable storage mediums (including but not limited to a disk memory, a CD-ROM, an optical memory, etc.) in which computer useable program codes are contained.

The disclosure has been described in a flow chart and/or a block diagram of the method, the device (system) and the computer program product according to the embodiments of the disclosure. It shall be appreciated that respective flows and/or blocks in the flow chart and/or the block diagram and combinations of the flows and/or the blocks in the flow chart and/or the block diagram can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow chart and/or the block(s) of the block diagram.

These computer program instructions can also be stored into a computer readable memory capable of directing the computer or the other programmable data processing device to operate in a specific manner so that the instructions stored in the computer readable memory create an article of manufacture including instruction means which perform the functions specified in the flow(s) of the flow chart and/or the block(s) of the block diagram.

These computer program instructions can also be loaded onto the computer or the other programmable data processing device so that a series of operational steps are performed on the computer or the other programmable data processing device to create a computer implemented process so that the instructions executed on the computer or the other programmable device provide operations for performing the functions specified in the flow(s) of the flow chart and/or the block(s) of the block diagram.

Although the preferred embodiments of the disclosure have been described, those skilled in the art benefiting from the underlying inventive concept can make additional modifications and variations to these embodiments. Therefore the appended claims are intended to be construed as encompassing the preferred embodiments and all the modifications and variations coming into the scope of the disclosure.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A method for driving a display panel, comprising:

receiving, by a data drive chip, an image to be displayed sent by a graphics processor, wherein the image to be displayed comprises grayscale data of a high-definition display area and a low-definition display area;

controlling, by the data drive chip, respective rows of sub-pixels containing the high-definition display area in a connected display panel to be scanned line by line, according to a position of the high-definition display area; and controlling, by the data drive chip, respective rows of sub-pixels containing only the low-definition display area in the display panel to be scanned per N rows simultaneously, according to a position of the low-definition display area, wherein N is an even number greater than 1;

wherein controlling, by the data drive chip, the respective rows of sub-pixels containing the high-definition display area in the connected display panel to be scanned line by line according to the position of the high-definition display area comprises:

inputting, by the data drive chip, same grayscale data to sub-pixels with a same display color connected with a same data line in the low-definition display area in every N rows of sub-pixels containing both the high-definition display area and the low-definition display area.

2. The method according to claim 1, wherein respective sub-pixels in every two adjacent rows of sub-pixels in the display panel are staggered by X sub-pixels in a column direction, wherein $0<X<1$, and each sub-pixel has a different display color from that of an adjacent sub-pixel.

3. The method according to claim 2, wherein controlling, by the data drive chip, the respective rows of sub-pixels containing only the low-definition display area in the display panel to be scanned per N rows simultaneously comprises:

inputting, by the data drive chip, same grayscale data to sub-pixels with a same display color connected with a same data line in every N rows of sub-pixels containing only the low-definition display area; and adjusting and outputting, by the data drive chip, corresponding grayscale data to an edge sub-pixel in an even row of sub-pixels containing only the low-definition display area, according to a grayscale and a weight of an adjacent sub-pixel with a same display color.

4. The method according to claim 1, wherein controlling, by the data drive chip, the respective rows of sub-pixels containing the high-definition display area in the connected display panel to be scanned line by line according to the position of the high-definition display area further comprises:

adjusting and outputting, by the data drive chip, corresponding grayscale data to an edge sub-pixel in an even row of sub-pixels in the low-definition display area in every N rows of sub-pixels containing both the high-definition display area and the low-definition display area, according to a grayscale and a weight of an adjacent sub-pixel with a same display color.

5. The method according to claim 2, wherein controlling, by the data drive chip, the respective rows of sub-pixels containing the high-definition display area in the connected display panel to be scanned line by line according to the position of the high-definition display area comprises:

adjusting and outputting, by the data drive chip, corresponding grayscale data to sub-pixels in the high-definition display area in the respective rows of sub-pixels containing the high-definition display area in the display panel, according to the grayscale data of the high-definition display area in the image to be displayed.

6. The method according to claim 1, wherein before the data drive chip receives the image to be displayed sent by the graphics processor, the method further comprises:

compressing, by the graphics processor, grayscale data of a low-definition display area in an original image according to a set compression ratio;

merging, by the graphics processor, the compressed grayscale data of the low-definition display area with the grayscale data of the high-definition display area and then sending them to the data drive chip; and stretching, by the data drive chip, the received grayscale data of the low-definition display area according to the number of data lines in the display panel and the compression ratio.

7. The method according to claim 6, wherein the compression ratio specifies N times of longitudinal compression.

8. The method according to claim 7, wherein stretching, by the data drive chip, the received grayscale data of the low-definition display area according to the number of data lines in the display panel and the compression ratio comprises:

stretching, by the data drive chip, the received grayscale data of the low-definition display area only transversely, according to the number of the data lines in the display panel and a transverse compression ratio in the compression ratio; wherein a transverse stretching ratio is in direct proportion to the number of the data lines and the transverse compression ratio in the compression ratio.

9. A display drive circuit, comprising a data drive chip and a graphics processor, wherein:

the graphics processor is configured to send an image to be displayed to the data drive chip, wherein the image to be displayed comprises grayscale data of a high-definition display area and a low-definition display area; and the data drive chip is connected with the graphics processor, and the data drive chip is configured to control respective rows of sub-pixels containing the high-definition display area in a connected display panel to be scanned line by line according to a position of the high-definition display area, and control respective rows of sub-pixels containing only the low-definition display area in the display panel to be scanned per N rows simultaneously according to a position of the low-definition display area, wherein N is an even number greater than 1;

wherein the data drive chip comprises:

a second processing element, configured to input same grayscale data to sub-pixels with a same display color connected with a same data line in the low-definition display area in every N rows of sub-pixels containing both the high-definition display area and the low-definition display area.

10. The display drive circuit according to claim 9, wherein respective sub-pixels in every two adjacent rows of sub-pixels in the display panel are staggered by X sub-pixels in a column direction, wherein $0<X<1$, and each sub-pixel has a different display color from that of an adjacent sub-pixel.

11. The display drive circuit according to claim 10, wherein the data drive chip further comprises:

a first processing element, configured to input same grayscale data to sub-pixels with a same display color connected with a same data line in every N rows of sub-pixels containing only the low-definition display area; and a first edge processing element, configured to adjust and output corresponding grayscale data to an edge sub-pixel in an even row of sub-pixels containing only the low-definition display area, according to a grayscale and a weight of an adjacent sub-pixel with a same display color.

12. The display drive circuit according to claim 9, wherein the data drive chip further comprises:

a second edge processing element, configured to adjust and output corresponding grayscale data to an edge sub-pixel in an even row of sub-pixels in the low-definition display area in every N rows of sub-pixels containing both the high-definition display area and the low-definition display area, according to a grayscale and a weight of an adjacent sub-pixel with a same display color.

13. The display drive circuit according to claim 10, wherein the data drive chip is further configured to adjust and output corresponding grayscale data to sub-pixels in the high-definition display area in the respective rows of sub-pixels containing the high-definition display area in the display panel, according to the grayscale data of the high-definition display area in the image to be displayed.

14. The display drive circuit according to claim 9, wherein the graphics processor comprises a compression element and a merging element, wherein:

the compression element is configured to compress grayscale data of a low-definition display area in an original image according to a set compression ratio;

the merging element is configured to merge the compressed grayscale data of the low-definition display area with the grayscale data of the high-definition display area and then send them to the data drive chip; and the data drive chip further comprises a stretching element, configured to stretch the received grayscale data of the low-definition display area according to the number of data lines in the display panel and the compression ratio.

15. The display drive circuit according to claim 14, wherein the compression ratio of the compression element specifies N times of longitudinal compression.

16. The display drive circuit according to claim 15, wherein the stretching element is configured to only stretch the received grayscale data of the low-definition display area transversely according to the number of the data lines in the display panel and a transverse compression ratio in the compression ratio; wherein a transverse stretching ratio is in direct proportion to the number of the data lines and the transverse compression ratio in the compression ratio.

17. A display device, comprising the display drive circuit according to claim 9, and a display panel.

18. A computer device, comprising:

a memory and a processor;

wherein the memory stores computer programs, and the computer programs are configured to be executed by the processor to perform the method according to claim 1.

* * * * *